US005214895A

United States Patent [19]

Fifield

[11] Patent Number: 5,214,895

[45] **Date of Patent: * Jun. 1, 1993**

[54] ROOF TILES

[75] Inventor: John A. Fifield, Buckinghamshire, Great Britain

[73] Assignee: Oldcastle, Inc., Los Angeles, Calif.

[ * ] Notice: The portion of the term of this patent subsequent to Jun. 28, 2090 has been disclaimed.

[21] Appl. No.: 791,752

[22] Filed: Nov. 12, 1991

Related U.S. Application Data

[63] Continuation-in-part of Ser. No. 536,591, Jun. 28, 1990, Pat. No. 5,070,671.

[51] Int. Cl.[5] ..... E04D 1/16

[52] U.S. Cl. ..... 52/533; 52/536; 52/542; 52/560

[58] Field of Search ..... 52/533, 536, 542, 560

[56] References Cited

U.S. PATENT DOCUMENTS

| | | | |
|---|---|---|---|
| D. 282,288 | 1/1986 | Bates . | |
| 147,061 | 2/1874 | Manvel . | |
| 426,584 | 4/1890 | Donaldson . | |
| 479,442 | 7/1892 | Marvick . | |
| 2,510,416 | 6/1950 | Pretty . | |
| 2,624,298 | 1/1953 | Farren . | |
| 4,065,899 | 1/1978 | Kirkhuff . | |
| 4,279,106 | 7/1981 | Gleason et al. . | |
| 4,506,483 | 3/1985 | Phalen, Jr. . | |
| 4,535,579 | 8/1985 | Burgoyne et al. . | |
| 4,731,969 | 3/1988 | Baker et al. . | |
| 5,070,671 | 12/1991 | Fifield et al. | 52/533 |

FOREIGN PATENT DOCUMENTS

| | | |
|---|---|---|
| 0095420 | 11/1983 | European Pat. Off. . |
| 0115374 | 8/1984 | European Pat. Off. . |
| 0175500 | 3/1986 | European Pat. Off. . |
| 0375802 | 7/1990 | European Pat. Off. . |
| 93888 | 12/1896 | Fed. Rep. of Germany . |
| 1259641 | 3/1961 | France . |
| 416649 | 9/1934 | United Kingdom . |
| 2046808 | 11/1980 | United Kingdom . |
| 2178773 | 2/1987 | United Kingdom . |

*Primary Examiner*—Richard E. Chilcot, Jr.
*Assistant Examiner*—Joanne C. Downs
*Attorney, Agent, or Firm*—Panitch Schwarze Jacobs & Nadel

[57] ABSTRACT

An interlocking roof tile which can be made by extrusion, pressing or moulding has an upper edge; a lower edge which is visible in use when the tile is laid in overlapping relationship with at least one tile of a next adjacent line of the tiles; an upper surface; a lower surface; a supporting understructure; two oppositely facing side edges; an underlock extending along one of the side edges and an overlock extending along the other of the side edges, the underlock having a lower end and an under surface which forms part of the under surface of the tile, and a lower edge portion having an under surface which includes a part of the under surface of the underlock, and which overlaps, in use, at least one tile of the next adjacent line of the tiles, characterized in that the upper surface of the tile extends continuously from the lower edge to the upper edge, in that the upper and lower surfaces are cambered from the lower edge to the upper edge and are substantially flat when considered in cross-section taken along a line extending between the side edges, in that the lower edge portion including the underlock has a taper which extends in the direction of the lower edge of the tile at least as far as the lower end of the underlock.

10 Claims, 10 Drawing Sheets

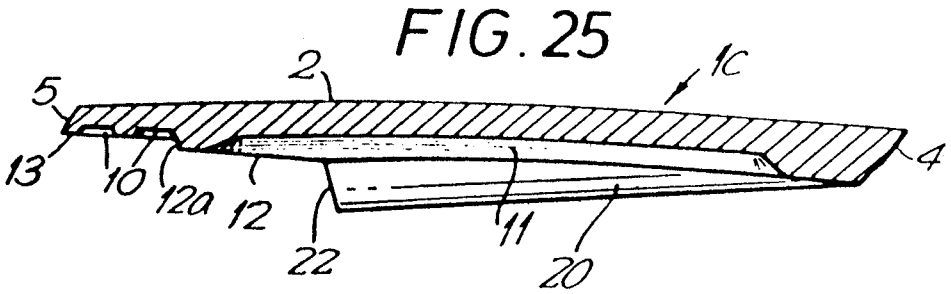
FIG. 25
FIG. 26
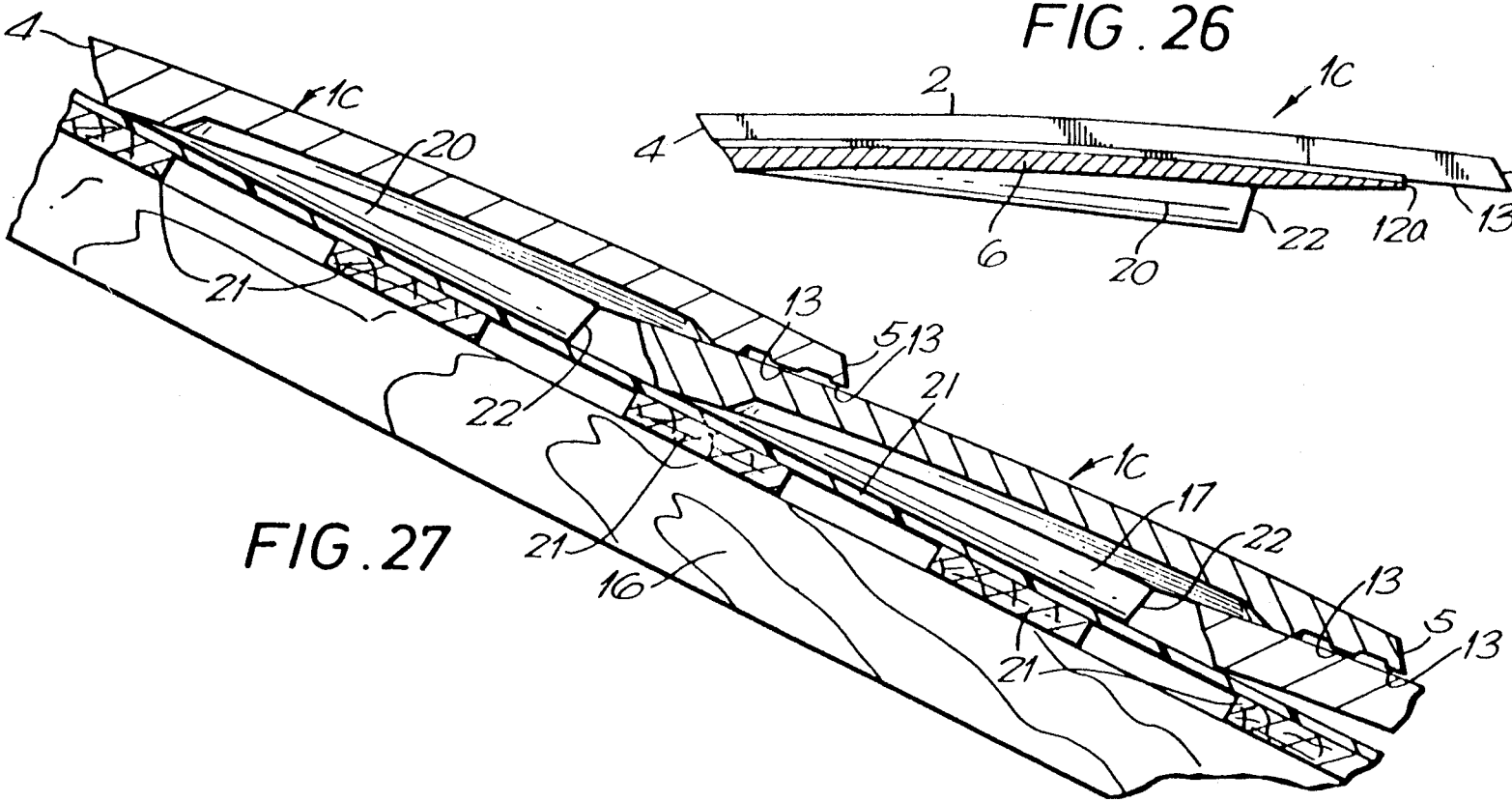
FIG. 27

ROOF TILES

CROSS-REFERENCE TO RELATED APPLICATION

This is a continuation-in-part of U.S. Pat. application Ser. No. 536,591 filed Jun. 28, 1990 now U.S. Pat. No. 5,070,671.

BACKGROUND OF THE INVENTION (a) Field of the Invention

The present invention relates to roof tiles and more particularly but not exclusively to roof tiles made of a cementitious mixture such as concrete or other material such as clay which are laid in straight or staggered relationship, e.g. so called slate and plain tiles.

(b) Description of the Prior Art

Roof tiles can be made from a cementitious mixture including sand and/or other aggregate, cement, colouring pigment and water plus optionally one or more other additives to facilitate extrusion, prevent growth of fungus, etc. Such tiles have been produced by extrusion for over forty years with apparatus including a hopper-like box which is disposed above a conveyor path and which is charged with the cementitious mixture. The flow of the cementitious mixture is assisted in the box by means of a rotating paddle disposed therewithin. A succession of pallets for moulding the lower surface of the tiles is driven along the conveyor path and beneath the box so that the cementitious mixture forms on the pallets and is compressed therein by means of a rotating roller disposed within the box downstream of the paddle and having a contour which corresponds to the upper surface of the tiles to be formed.

The cementitious mixture is further compressed on the pallets as they pass out of the box by means of a slipper which is disposed downstream of the roller and also has a contour which corresponds to that of the upper surface of the tile to form a continuous extruded ribbon of cementitious mixture on the pallets. The ribbon is subsequently cut into tile forming lengths downstream of the box by means of a suitable cutting knife and the pallets with the formed tiles thereon are conveyed to a curing location. At the curing location, the tiles are conveyed through a curing chamber which is maintained at a high relative humidity and temperature. The curing time is usually in excess of 6 hours. The tiles undergo only a partial curing in the curing chamber from whence they are conveyed to, and stacked, normally out-of-doors, to complete the curing process.

Natural slate and concrete plain tiles are, as is known, laid on the roof in staggered relationship and double lapped, i.e. so that there is always a tile underneath the abutting side edges of adjacent tiles to guard against rain and wind driven water entering into the roof space between the abutting side edges. Traditionally, natural slates have a generally flat geometry with a substantially constant thickness of approximately 10 mm and have a laid weight of approximately 20–40 Kg/m$^2$. On the other hand, conventional concrete plain tiles have a cambered geometry, a substantially constant thickness of approximately 12 mm and a laid weight of 75 Kg/m$^2$. With both natural slate and concrete plain tiles the thickness of the visible lower edge, (i.e. that edge which is the lower edge when the tiles are laid in overlapping relationship with a next adjacent line of tiles), when the tiles are laid provides an aesthetically pleasing appearance. However, it has long been an object to avoid the necessity to double lap the tiles to reduce the number of laid tiles per roof and therefore the cost but still retain the aesthetic appearance produced by laying in staggered relationship, and a visible lower edge similar to existing clay and concrete plain tiles, and natural slates, in particular in the case of retiling old roofs.

Applicant's assignee has manufactured interlocking extruded concrete slate tiles which avoid the necessity for double lapping and which have the generally flat geometry of natural slate and a substantially constant edge thickness. However, the lower edge thickness is 25 mm and is necessary in order to provide sufficient strength to avoid breaking off, and to accommodate, the interlocks, i.e. the over and underlocks extending along opposite side edges respectively of each tile. Whilst such concrete slate tiles are designed to be laid in staggered relationship, they are not specified in preference to natural slate and conventional plain tiles because the aesthetic appearance is wrong, i.e. the lower edge thickness is twice that of the optimum required thickness. Furthermore, although the lower surfaces of the tiles have been hollowed out to reduce the weight, the laid weight of these known concrete/interlocking slates is still about 40 to about 60 Kg/m$^2$ which is considerably more than that of natural slates so that the replacement of natural slates by concrete slates in retiling would require the additional expense of strengthening or replacing the roof timbers.

Even if these known concrete slates were made of material which reduced the weight and thickness of tiles, such a step would decrease the lower edge thickness only down to about 17 to about 20 mm which is still too thick to compete against natural slates and conventional plain tiles.

In the tiles described with reference to, and as illustrated in the drawings of, U.S. Pat. Application Ser. No. 536,591, filed Jun. 28, 1990, the tile lower surfaces are each provided with two or more hanging nibs which enable the tiles to be mounted on battens, fixed to, and extending transversely of, the rafters of a roof, with roof felt interposed therebetween. However, such hanging nibs render the tiles unsuitable for decked pitched roof structures which are in common use in a number of countries, in particular in the U.S. of America. In such pitched roof structures having decking overlying roof rafters, slates, for example, are fixed directly to the decking with there being roof felt interposed between the slates and decking. Whilst, the decking can be continuous, it need not be so. Testing methods, according to the Uniform Building Code Standards, of roofing materials are based on gaps of 5.5 inches between boards spanning the rafters supporting roof tiles. The tiles of the present invention meet these standards.

Accordingly, the main object of the present invention is to provide an interlocking roof tile which can be laid in a straight relationship or a staggered relationship, which can be used for decked pitched roof structures and which can serve as a replacement for slates, shakes or asphalt shingles on such roof structures.

SUMMARY OF THE INVENTION

The present invention comprises an interlocking roof tile having an upper edge; a lower edge which is visible in use when the tile is laid in overlapping relationship with at least one tile of a next adjacent line of the tiles; an upper surface; a lower surface; a supporting understructure; two oppositely facing side edges; an underlock extending along one of the side edges; and an overlock extending along the other of the side edges; the underlock having a lower end and an under surface which forms part of the lower surface of the tile; and a lower edge portion having an under surface which includes a part of the under surface of the underlock, and which overlaps, in use, at least one tile of the next adjacent line of the tiles; characterized in that the upper surface of the tile extends continuously from the lower edge to the upper edge, in that the upper and lower surfaces are cambered from the lower edge to the upper edge and are substantially flat when considered in cross-section taken along a line extending between the side edges, in that the lower edge portion including the underlock has a taper which extends in the direction of the lower edge of the tile at least as far as the lower end of the underlock so that, in use, the under surfaces of the lower edge portion and the underlock overlie the continuous upper surface of at least one tile of the next adjacent line of the tiles, whereby the lower end of the interlocking roof tile is of reduced thickness and the interlocking roof tile can be laid in either a straight relationship or a staggered relationship with respect to the next adjacent line of the tiles, and in that the tile is capable of being supported by its understructure on decking of a decked roof.

BRIEF DESCRIPTION OF THE DRAWINGS

The foregoing summary of the invention, as well as the following detailed description of preferred embodiments, will be better understood when read in conjunction with the appended drawings. For the purpose of illustrating the invention, there are shown in the drawings embodiments which are presently preferred, it being understood, however, that the invention is not limited to the specific arrangements disclosed.

FIGS. 25 and 26 are cross-sections taken along the lines C—C and D—D respectively of FIG. 22.

FIG. 27 is a diagrammatic cross-section through a decked pitched roof including tiles such as those illustrated in FIGS. 19 to 26.

In the drawings the same reference characters are used to designate the same or similar parts.

DETAILED DESCRIPTION OF THE PREFERRED EMBODIMENTS

Figure 1:
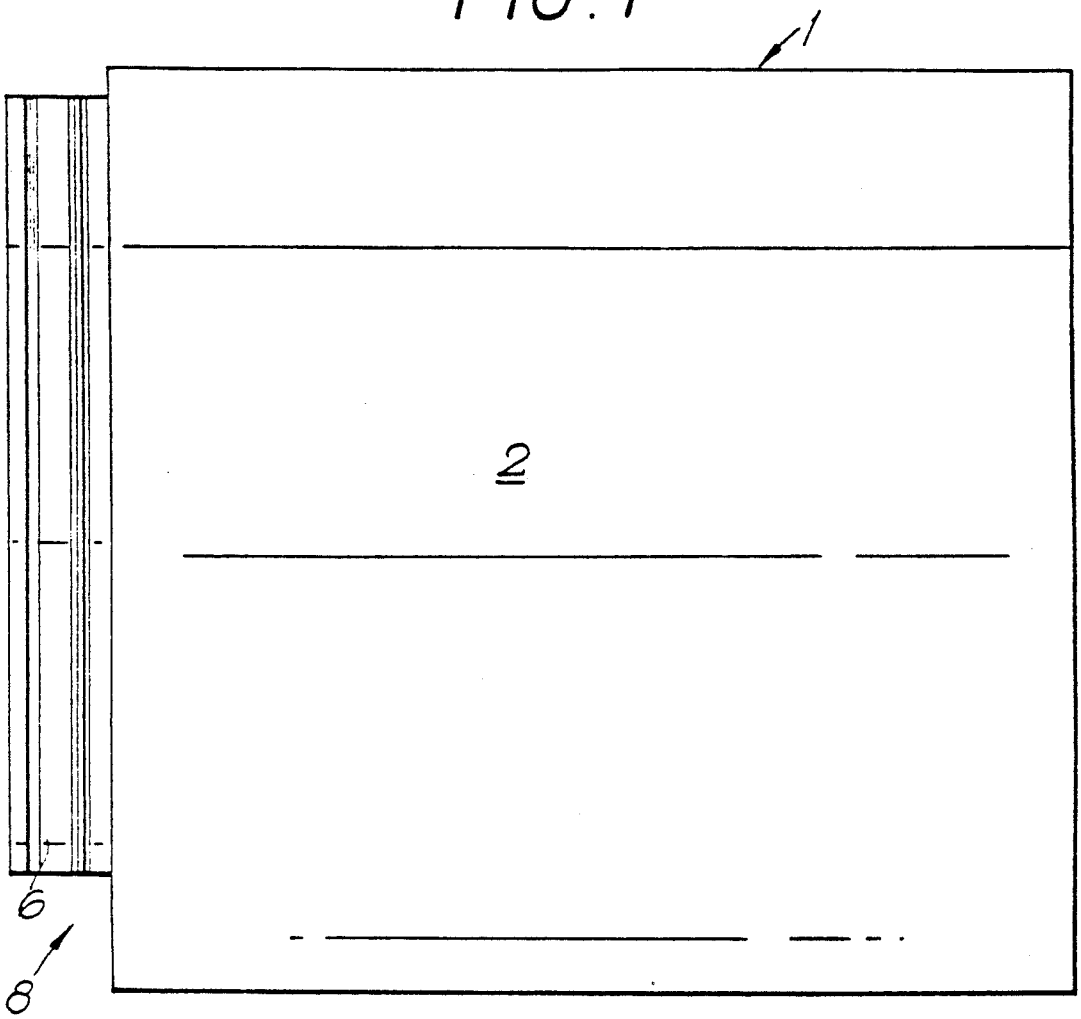
FIG. 1 is a top plan view of one embodiment of concrete roof tile made in accordance with the invention and in the form of an interlocking concrete slate.

By means of the invention the lower edge thickness may be substantially reduced, i.e. to as little as approximately 10 mm, which is less than that of conventional plain tiles and compares favourably with the body thickness of natural slates. Without changing the tile extrusion head, in the case of extruded tiles, a concrete slate tile can be transformed into a plain tile or rather a double-plain tile by a simple operation performed either on the upper surface of the extruded cementitous material ribbon or tile forming lengths, severed from the ribbon.

Thus, the invention provides interlocking roof tiles which have the appearance and perceived thickness of plain tiles or similar thickness to natural slate and which are capable of being laid either in straight or staggered relationship and of being made to a laid weight of, say, approximately 20 to 40 $Kg/m^2$ and preferably of 20 to 28 $Kg/m^2$, thereby to form a completely satisfactory replacement for natural slate roofing in decked pitched roof structures. The tiles of the present invention may be made by pressing, moulding or extrusion from a cementitious mixture. Where extrusion is used, it is not necessary to perform any subsequent operations on the upper surface of the tile.

In some instances it may be aesthetically desirable for the underlock not to be visible when laid, to which end the underlock may end short of the lower edge of the tile.

With such a construction it is possible to have the under surface of the lower edge portion of the tile beyond the lower end of the underlock disposed generally parallel to the opposed upper surface of the tile, which reduces the amount of material required to make the tile and therefore its weight.

Conveniently, therefore, there is a step between the lower end of the underlock and the under surface of the adjacent lower edge portion of the tile beyond the underlock.

Applicant has made such tiles with a reduction in the thickness of the lower edge of approximately 6 mm.

Preferably the underlocks for such tiles will be typically approx. 8 mm thick at the thickest point reducing to approx. 4 mm thick at the overlapping portion.

Furthermore, by means of the tapered lower edge portion of the tile, the tile under surface in the lower edge region can closely overlie the upper surface of the next adjacent lower line of the tiles.

The scale of the thinning to produce the tapered lower edge portion of the tile advantageously enables there to be an overlap with each next adjacent lowest line of tiles of typically 75 mm approx. and the tile to have a camber of approx. 1600–1800 mm, radius of curvature.

Advantageously, the tile is made of any of the cementitious mixtures or materials described in the specification of our copending U.S. Pat. application Ser. No. 348,639 filed Aug. 22, 1988, the subject matter of which is incorporated into the specification of this application by reference.

More particularly, in a preferred embodiment of the present invention, the interlocking roof tile is made from a cementitious mixture comprising a porous lightweight aggregate capable of retaining water, an hydraulic cement, water, an agent for enhancing flexural strength and an agent for enhancing the water retention capacity of the porous lightweight aggregate during curing of the interlocking roof tile, with the porous lightweight aggregate, hydraulic cement, water, flexural strength enhancing agent and water retention enhancing agent being present in proportions which provide the interlocking roof tile with improved impact and flexural strengths.

In order to provide a plain tile instead of a concrete slate, the upper surface of the extruded ribbon or tile forming lengths are provided with a continuous or non-continuous groove, e.g. by means of a knife or wheel, which extends from the upper edge to the lower edge of the tile. Thus, there is, in effect, produced a one piece tile which has the appearance of two plain tiles. It should be understood that, in this specification, reference to a plain tile includes such a tile having the appearance of two or more plain tiles.

Whilst the supporting understructure may be of any suitable form, shape or configuration it preferably has a longitudinally extending component, i.e., extends from or between the upper and lower edges of the tile.

Thus, advantageously, the supporting understructure comprises at least one, or a plurality of, longitudinally extending ribs or ridges which project from the lower surface of the tile.

The ribs or ridges preferably are continuous but may be discontinuous if desired. Thus, the supporting understructure may comprise a multiplicity of pegs or projections which may be disposed in any suitable manner consistent with achieving the desired support, such as in longitudinally extending rows.

In order to preserve lower edge thickness, which corresponds to, or approaches, that of slates which tiles made in accordance with the present invention may replace, the supporting understructure ideally stops short of the lower edge of the tile.

Preferably, also, the supporting understructure is tapered in the direction of the upper edge of the tile.

The supporting understructure will, whether continuous as with ribs or ridges, or discontinuous in the case of pegs or projections, rest against or abut the decking up to a maximum air gap of 5.5 inches between individual boards.

The concrete slate 1 shown in FIGS. 1, 2, 3, 7, 8, 9, 10 and 11 is of generally rectangular configuration when considered in plan, and has upper and lower surfaces 2 and 3 respectively, an upper edge 4, a lower edge 5 and interlocks extending along its oppositely facing side edges in the form of an underlock 6 and an overlock 7, which respectively engage with the over and underlocks of adjacent tiles of the same row. In the lower edge region of the tile, the underlock 6 ends short of the lower edge 5 to provide a cut-out 8, which enables the aesthetic appearance of a natural slate and normal plain tile to be maintained because the underlocks preferably do not extend to the lower edges of the tiles and are therefore not visible when the tiles are laid on a roof.

Figure 6:
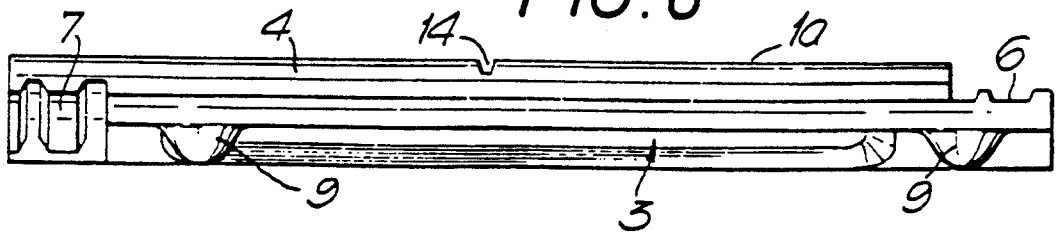
Figure 7:
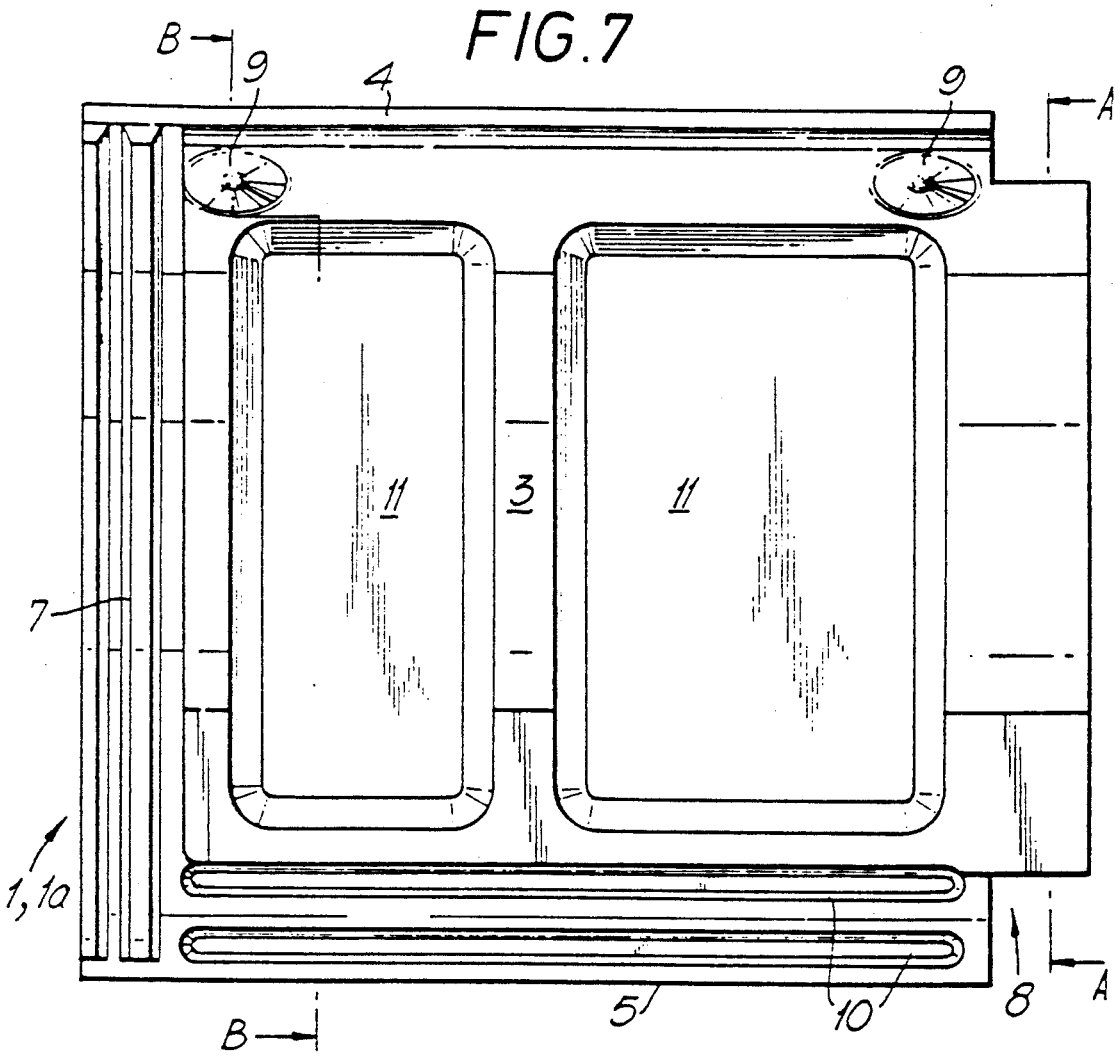
FIG. 7 is an underneath plan view of the concrete slate of FIG. 1 and the plain tile of FIG. 4.
Figure 8:
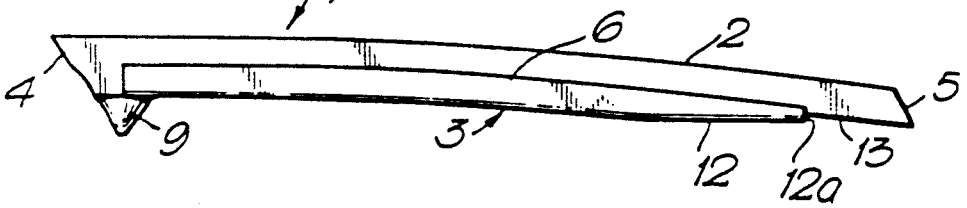
FIGS. 8 and 9 are opposite side views respectively of the concrete slate of FIG. 1 and plain tile of FIG. 4.
Figure 9:
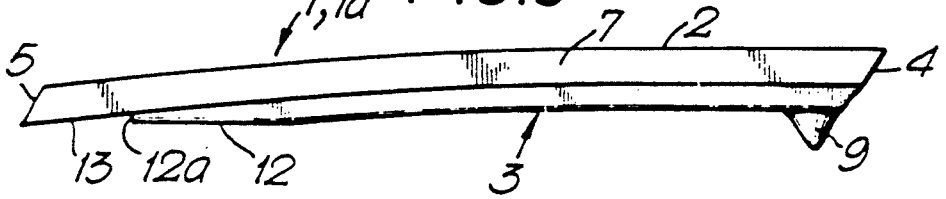
Figure 10:
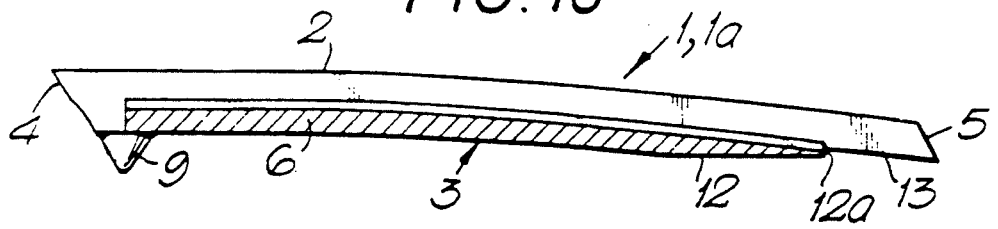
FIGS. 10 and 11 are cross-sections taken along the lines A—A and B—B respectively of FIG. 7.
Figure 11:
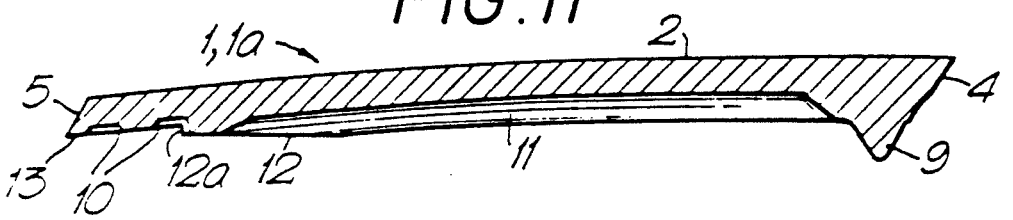

As is shown in FIG. 7, the understructure of the tile includes the lower surface 3 of the tile and is provided with two or more hanging nibs such as 9 and wind barriers 10. The tile may be provided with nail holes (not shown) adjacent the nibs 9 or, alteratively, as is preferred, securing clips (not shown) may be used instead of nails. Also, the lower surface has hollowed out portions 11, as is known, to reduce weight. The tile 1 is of cambered geometry, i.e. the upper and lower surfaces are cambered, with the camber extending from the upper edge 4 to the lower edge 5 and the upper surface 2 of the tile extends continuously from the lower edge 5 to the upper edge 4, as will be apparent from FIGS. 8 to 11, and the upper and lower surfaces 2 and 3 are substantially flat when considered in cross-section, taken along a line extending between the side edges of the tile, as will be apparent from FIGS. 2, 3, 5 and 6.

As will be readily apparent from FIGS. 8 to 12, the lower edge portion 12 of the tile, at least as far as the lower end of the underlock 6, is tapered in the direction of the lower edge 5, i.e. is thinned, by making the pallets on which the tiles are extruded of an appropriate shape, thereby to produce a lower edge which is aesthetically acceptable. It should be appreciated that the tapered area extends transversely across the lower surface of the tile except for the hollowed out portions. Furthermore, the under surface 13 of the lower edge portion 12 beyond the underlock 6 extends generally parallel to the upper surface 2 of the tile with there being a step 12*a* between the under surface 13 adjacent the lower edge 5 and the under surface of the tapered lower edge portion 12 of the underlock 6.

Figure 2:
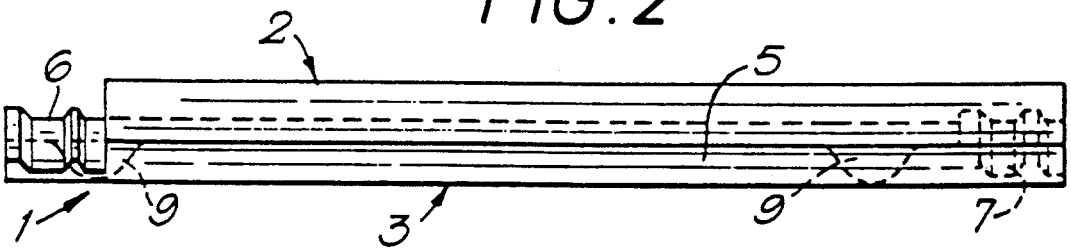
FIGS. 2 and 3 are lower and upper edge views respectively of the slates of FIG. 1.
Figure 3:
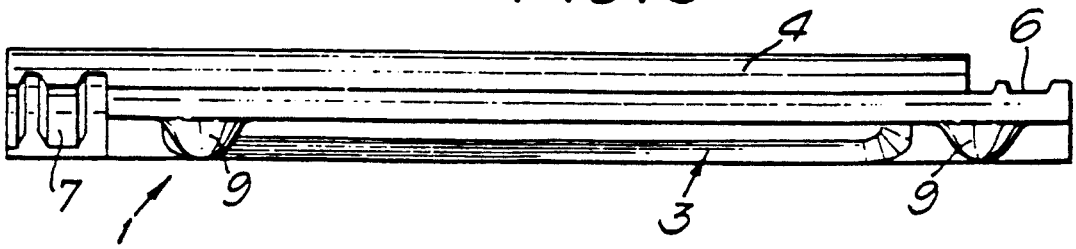
Figure 4:
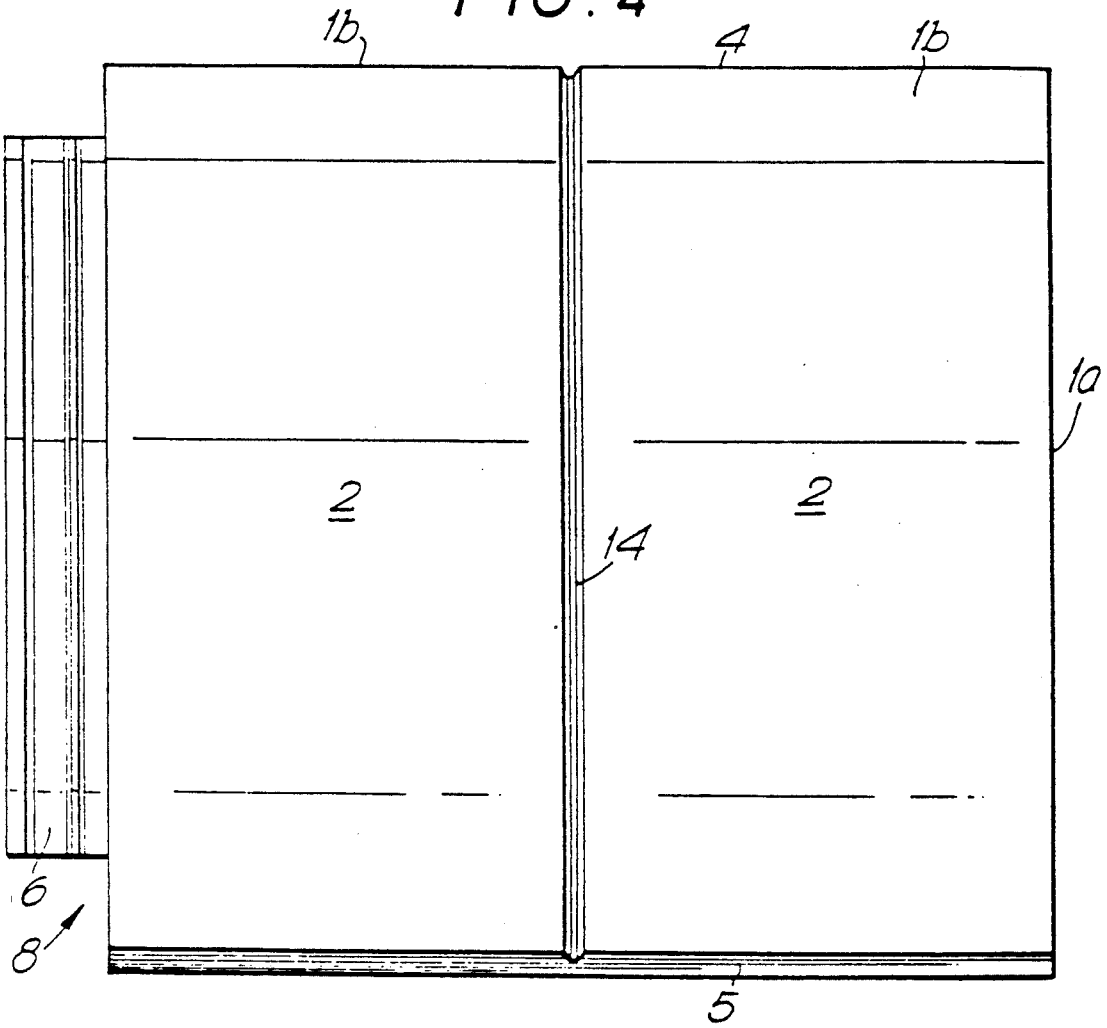
FIG. 4 is a top plan view of another embodiment in the form of a concrete interlocking double plain tile.
Figure 5:
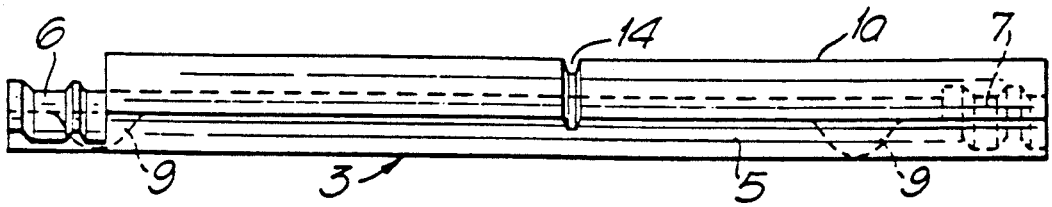
FIGS. 5 and 6 are lower and upper edge views respectively of the tile of FIG. 4.

The plain tile la illustrated in FIGS. 4, 5 and 6 differs from the concrete slate illustrated in FIGS. 1 and 2 only in that it has a longitudinal groove 14 running the full length of the tile 1*a* to form a one piece two tile plain tile 1*a*, each of which is designated by the reference 1*b*.

Figure 12:
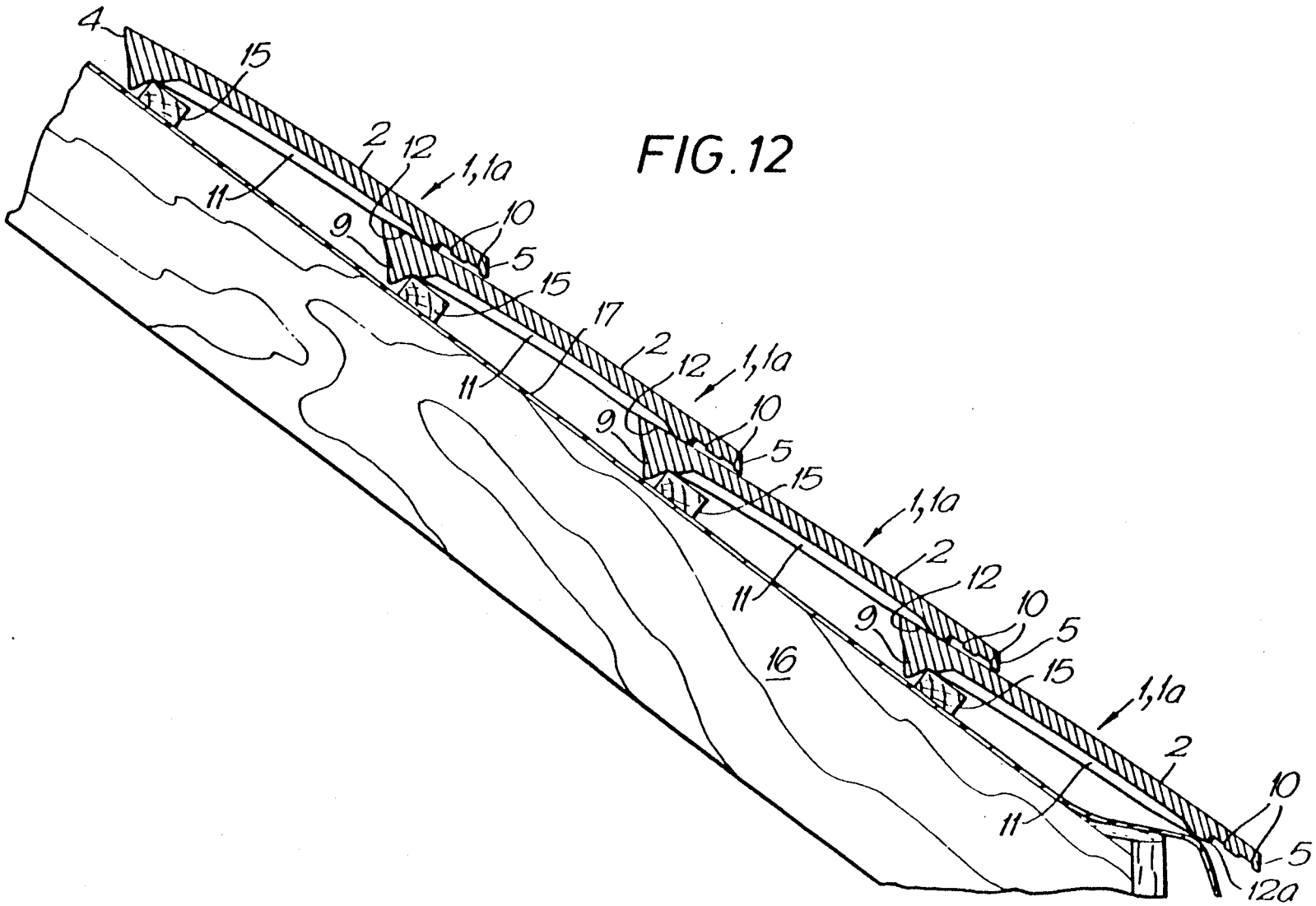
FIG. 12 is a diagrammatic cross-section through a roof structure tiled with the concrete slates of FIG. 1 or plain tiles of FIG. 4.

In FIG. 12, the tiles 1 or la are mounted on battens 15 fixed to roof rafters such as 16 with the roof felt being shown at 17.

Figure 15:
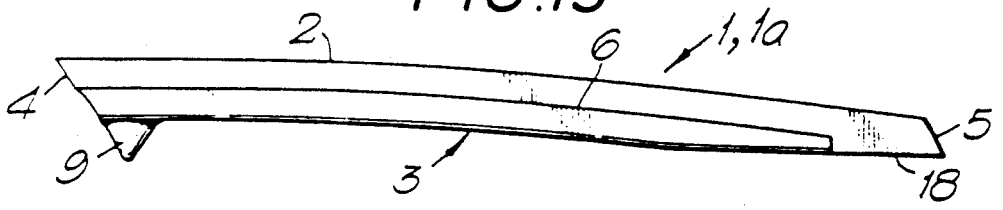
FIGS. 15 and 16 are opposite side views similar to those of FIGS. 8 and 9 of another embodiment.
Figure 16:
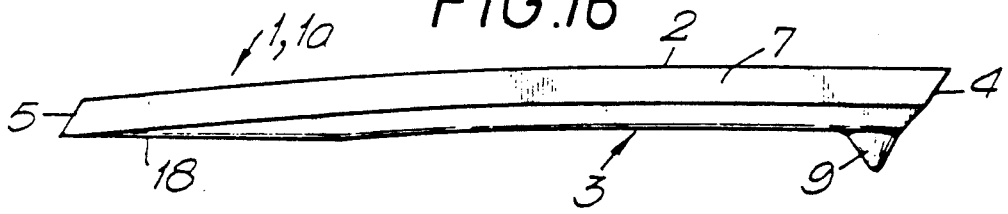
Figure 17:
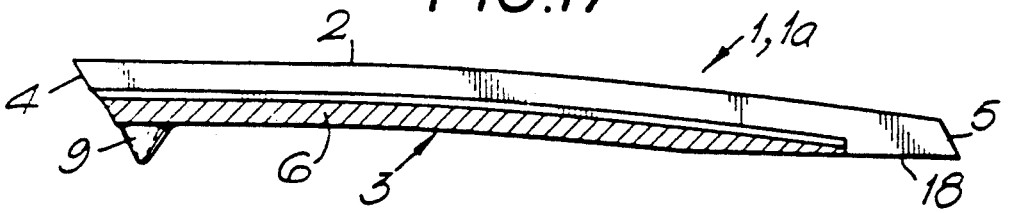
FIGS. 17 and 18 are cross-sections similar to those of FIGS. 10 and 11 of the embodiment of FIGS. 15 and 16.
Figure 18:
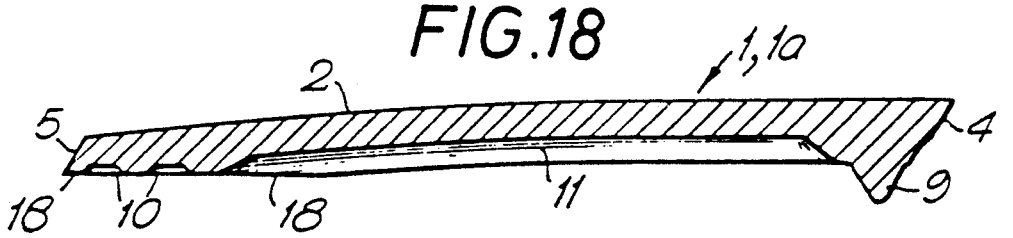
Figure 13:
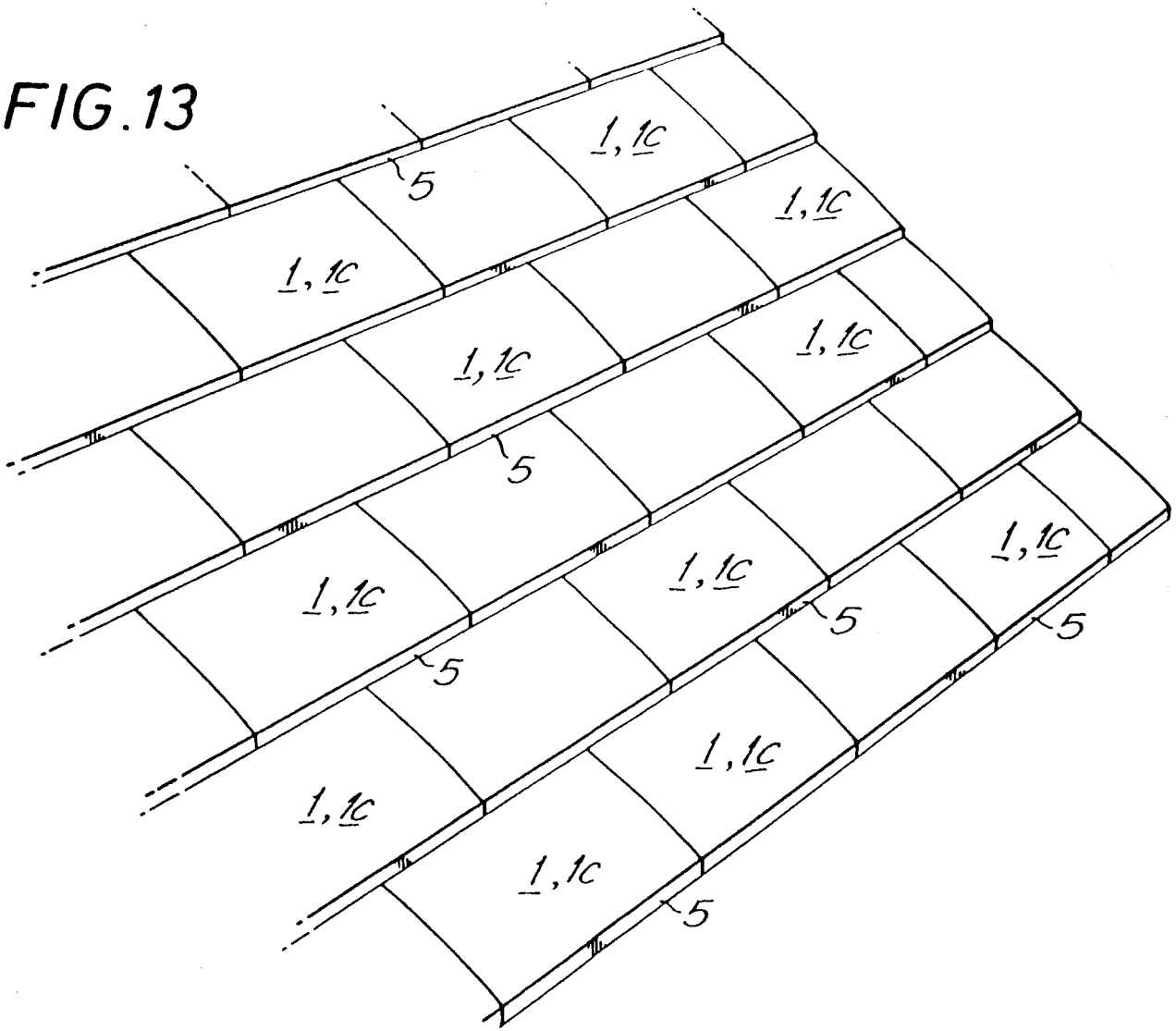
FIG. 13 is a diagrammatic perspective view of a tiled roof tiled with the slates of FIG. 1 or tiles of FIG. 19.
Figure 14:
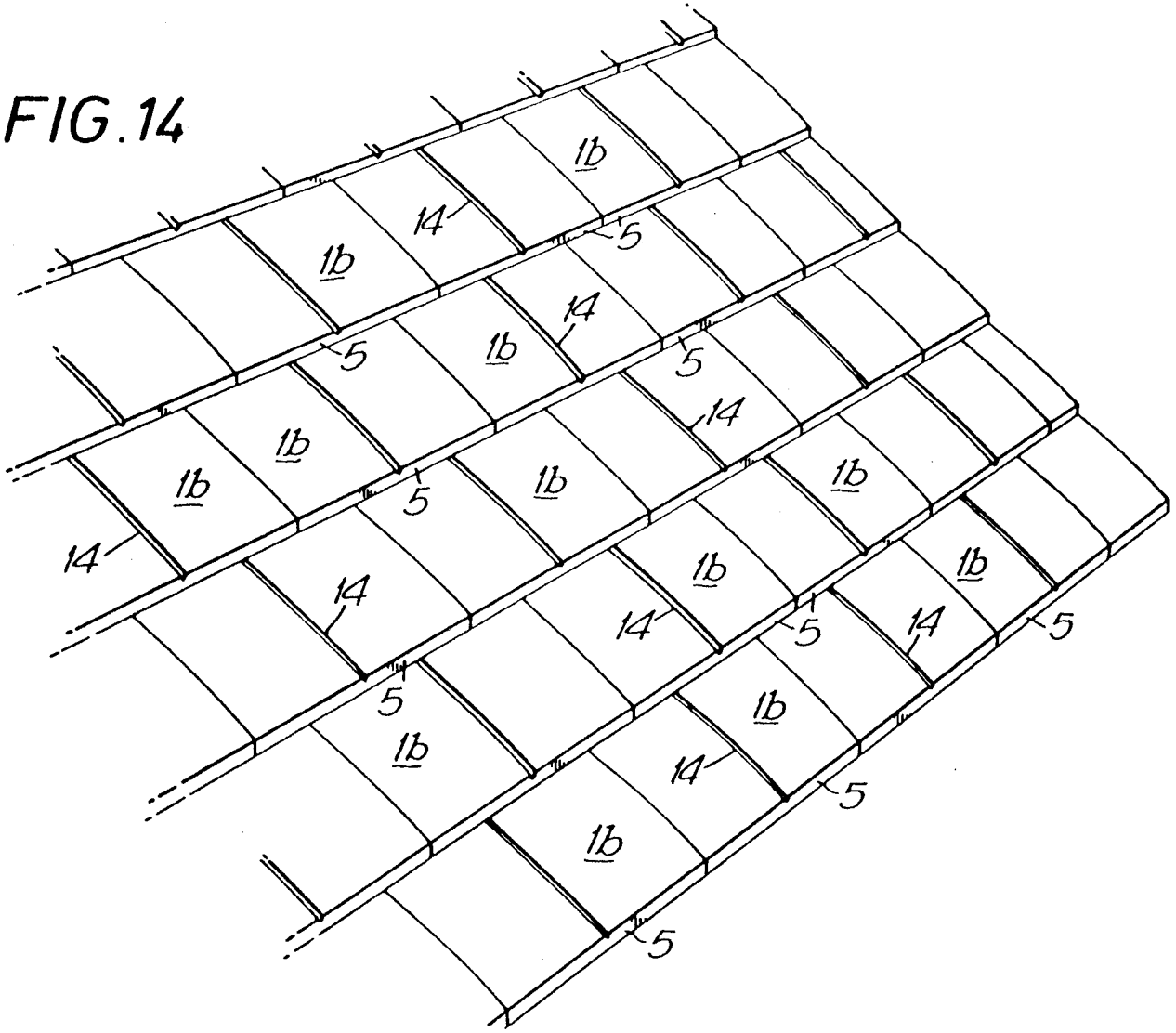
FIG. 14 is a diagrammatic perspective view of a tiled roof tiled with the plain tiles of FIG. 4.
Figure 19:
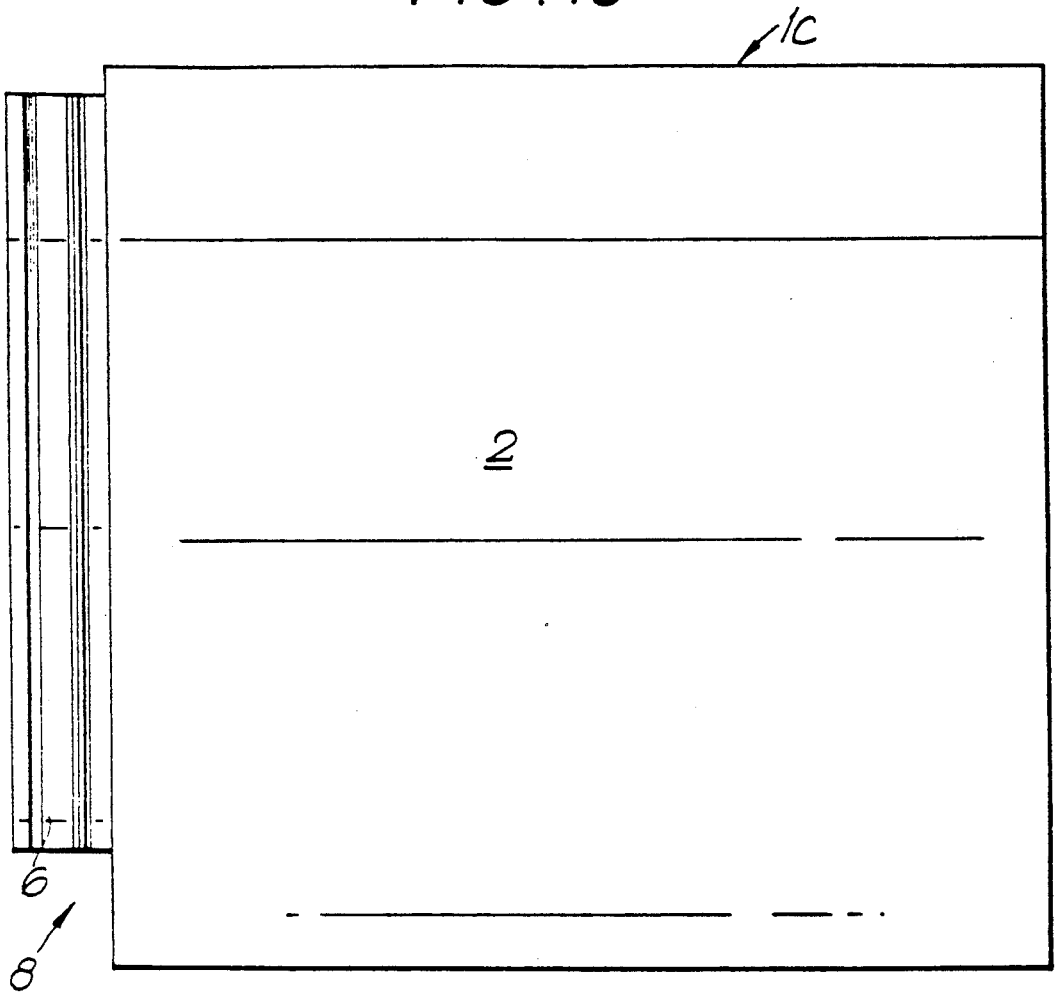
FIG. 19 is a top plan view of an alternative embodiment of roof tile, for use in decked pitched roof structures.
Figure 20:
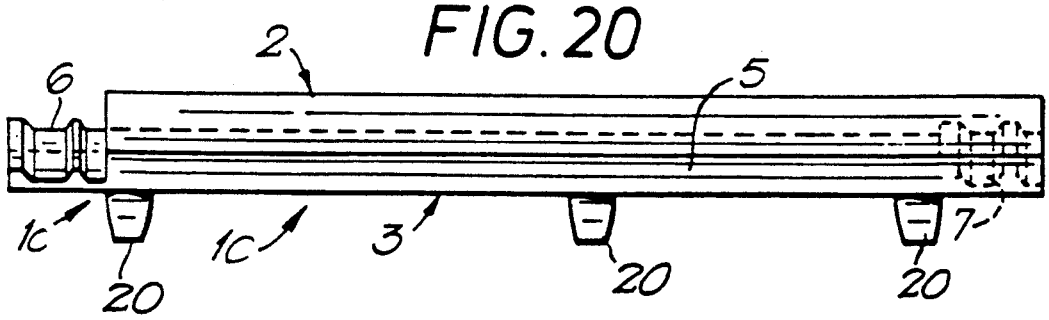
FIGS. 20 and 21 are lower and upper edge views respectively of the tile of FIG. 19.
Figure 21:
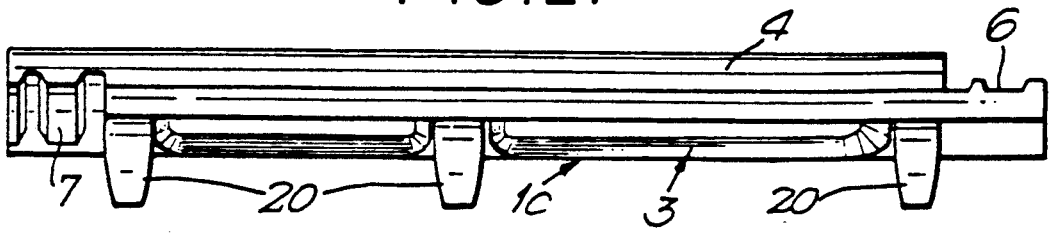
Figure 22:
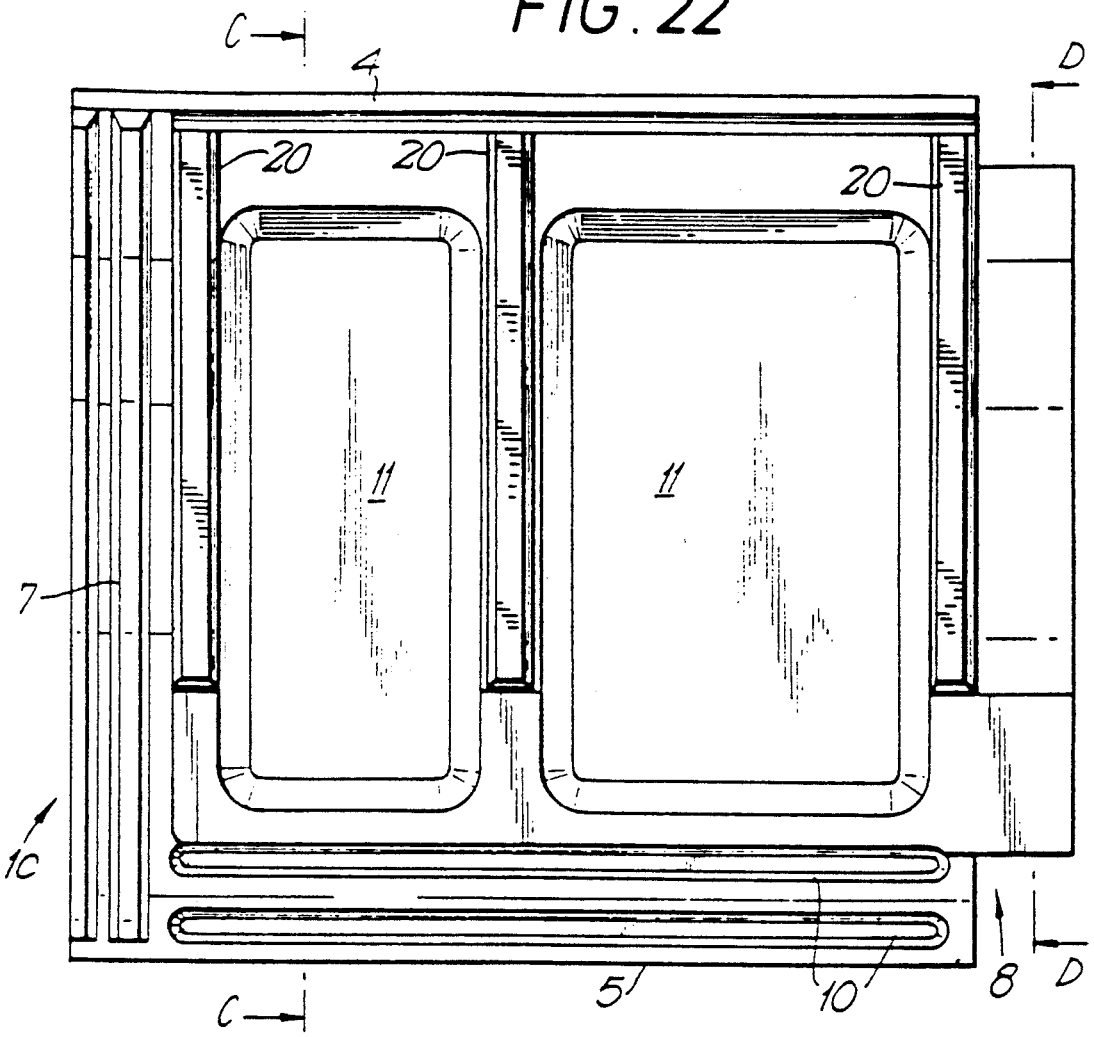
FIG. 22 is an underneath plan view of the tile of FIG. 19.
Figure 23:
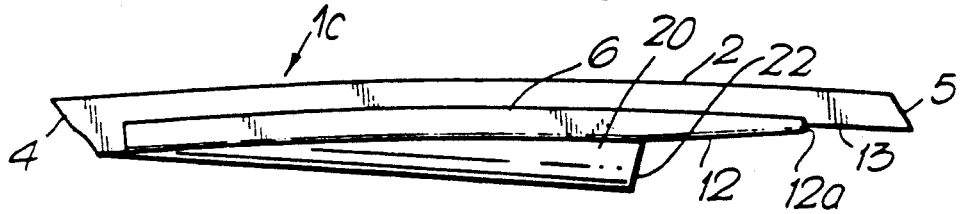
FIGS. 23 and 24 are opposite side views of the tile of FIG. 19.
Figure 24:
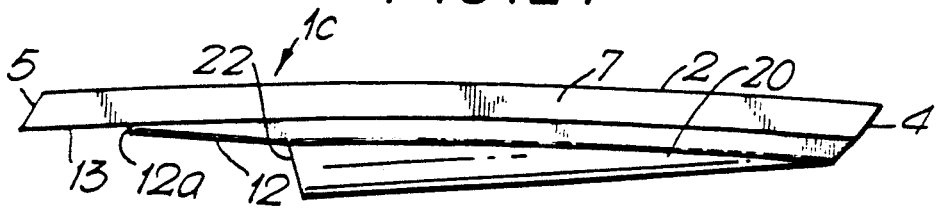

FIGS. 13 and 14 respectively show how the concrete slates 1 and plain tiles la (tiles lb) appear as a tiled roof with their narrow, aesthetically acceptable lower edges 5. The embodiment of FIGS. 15 to 18 differs from those of FIGS. 1 to 11, in that the under surface of the tapering lower edge portion 12 of the underlock merges or extends into the under surface of the lower edge portion of the tile adjacent the lower edge 5 without a step 12*a* to form a tapered under surface 18, which extends transversely across the tile, which merges with the cambered lower surface 3 of the tile and which is inclined at an angle to the upper surface 2 of the tile. The tapering nature of the surface 18 can be readily appreciated from FIGS. 17 and 18. The tiles of FIGS. 15 to 18 lie in a similar manner to those of FIGS. 1 to 11 as shown in FIGS. 12 to 14. However, an advantage of the embodiment of FIGS. 1 to 11 as compared to that of FIGS. 15 and 16 is that less material is required for the lower edge portion between the lower end of the underlock 6 and the lower edge 5, thereby further reducing the weight of the tiles.

Referring to the alternative embodiment of FIGS. 19 to 27, this differs from those of the previous embodiments in that the hanging nibs 9 are omitted and, instead, the supporting understructure of the tile 1*c* has one or more, in this case three, longitudinally extending reinforcing ribs 20 which are tapered in the direction of the upper edge 4 and which constitute a supporting understructure for supporting the tiles 1*con*, and for enabling the tiles to be directly supported on roof decking 21, as shown in FIG. 27 (the customary fasteners such as nails or clips not being illustrated for purposes of clarity). The ribs 20 have a lower edge 22, such that the ribs stop short of the lower edge 5 of the tile 1*c* to provide for the desired amount of overlap with the tiles of the next course of tiles 1*c* down the roof. And the ribs 20 taper in the direction of the upper edge 4 of the tile 1*c*. As set forth above, although the ribs 20 are illustrated as continuous longitudinal ribs, the supporting understructure may be in the form of discontinuous ribs, pegs on projections which bear against and thereby, are supported on the roof decking. A roof comprising tiles 1*c* looks like that shown in FIG. 13.

It should be appreciated that the invention is not limited to the embodiments described. For example, in the embodiment of FIG. 4, the groove 14 need not extend the whole length of the tile, e.g. it may be eliminated in the region of the overlap. By way of further examples of modifications, the tile embodiment illustrated in FIGS. 19–27 may have a lower edge portion with an under surface similar to the under surface 18 as shown in FIGS. 15–18. Moreover, whilst the invention is particularly applicable to extruded roof tiles made of cementitious mixtures, such as concrete, the roof tiles could equally be made of clay which could be pressed, moulded or extruded, and the cementitious material or concrete tiles can also be made by pressing or moulding. Furthermore, it should be understood that the expression "roof" tiles also includes cladding tiles.

The present invention may be embodied in other specific forms without departing from the spirit or essential attributes thereof and accordingly, reference should be made to the appended claims, rather than to the foregoing specification as indicating the scope of the invention.

I claim:

1. An interlocking roof tile having an upper edge; a lower edge which is visible in use when the tile is laid in overlapping relationship with at least one tile of a next adjacent line of the tiles; an upper surface; a lower surface; a supporting understructure; two oppositely facing side edges; an underlock extending along one of the side edges and an overlock extending along the other of the side edges; the underlock having a lower end and an under surface which forms part of the lower surface of the tile, and a lower edge portion having an under surface which includes a part of the under surface of the underlock, and which overlaps, in use, at least one tile of the next adjacent line of the tiles; characterized in that the upper surface of the tile extends continuously from the lower edge to the upper edge, in that the upper and lower surfaces are cambered from the lower edge to the upper edge and are substantially flat when considered in cross-section taken along a line extending between the side edges, in that the lower edge portion including the underlock has a taper which extends in the direction of the lower edge of the tile at least as far as the lower end of the underlock so that, in use, the under surfaces of the lower edge portion and the underlock overlie the continuous upper surface of at least one tile of the next adjacent line of the tiles, whereby the lower end of the interlocking roof tile is of reduced thickness and thereby aesthetically acceptable and the interlocking roof tile can be laid in either a straight relationship or a staggered relationship with respect to the next adjacent line of the tiles, and in that the interlocking roof tile is capable of being supported by its understructure on decking of a decked roof.

2. A roof tile as claimed in claim 1 and made from a cementitious mixture comprising a porous lightweight aggregate capable of retaining water, an hydraulic cement, water, an agent for enhancing flexural strength and an agent for enhancing the water retention capacity of the porous lightweight aggregate during curing of the tile, with the porous lightweight aggregate, hydraulic cement, water, flexural strength enhancing agent and water retention enhancing agent being present in proportions which provide the interlocking roof tile with improved impact and flexural strengths, and having a laid weight of approximately 20 to 40 $Kg/m^2$ to provide replacement for natural slate roofing which does not require additional expense of strengthening roof timbers.

3. A roof tile as claimed in claim 1, wherein the under surface of the lower edge portion of the tile beyond the lower end of the underlock is disposed generally parallel to that part of the continuous upper surface of the tile which is opposed to the under surface of the lower edge portion and wherein there is a step between the lower end of the underlock and the under surface of the adjacent lower edge portion of the tile beyond the underlock.

4. A roof tile as claimed in claim 1, wherein the tapered under surface of the underlock merges into the under surface of the lower edge portion of the tile adjacent the lower edge of the tile.

5. A roof tile as claimed in claim 1, wherein the supporting understructure has a longitudinally extending component which extends from at least one of the upper and lower edges of the tile towards the other of the lower and upper edges of the tile.

6. A roof tile as claimed in claim 1, wherein the supporting understructure extends from the upper edge of the tile and stops short of the lower edge of the tile.

7. A roof tile as claimed in claim 1, wherein the supporting understructure tapers in the direction of the upper edge of the tile.

8. A roof tile as claimed in claim 1, wherein the supporting understructure comprises at least one longitudinally extending rib which projects from the lower surface of the tile.

9. A roof tile as claimed in claim 1, wherein the supporting understructure comprises a plurality of projections projecting from the lower surface of the tile.

10. A roof tile as claimed in claim 1 and made by extrusion, pressing or moulding.

* * * * *